US007682039B2

(12) United States Patent
Kuo et al.

(10) Patent No.: US 7,682,039 B2
(45) Date of Patent: Mar. 23, 2010

(54) EXTENSIBLE LIGHT SHADE

(75) Inventors: Shu Shoung Kuo, Hsin-Tien (TW); Yen Fu Liu, Hsin-Tien (TW); Yu Yang Liu, Hsin-Tien (TW)

(73) Assignee: Ledtech Electronics Corp., Hsin-Tien (TW)

( * ) Notice: Subject to any disclaimer, the term of this patent is extended or adjusted under 35 U.S.C. 154(b) by 155 days.

(21) Appl. No.: 11/743,345

(22) Filed: May 2, 2007

(65) Prior Publication Data

US 2008/0198590 A1 Aug. 21, 2008

(30) Foreign Application Priority Data

Feb. 16, 2007 (TW) ..... 96105867 A

(51) Int. Cl.
*F21S 4/00* (2006.01)

(52) U.S. Cl. ..... 362/219; 362/640; 439/314

(58) Field of Classification Search ..... 362/640, 362/647, 653, 658, 659, 217, 219, 225; 439/22, 439/314, 332–334, 240, 241, 232, 953
See application file for complete search history.

(56) References Cited

U.S. PATENT DOCUMENTS

| | | | | |
|---|---|---|---|---|
| 3,136,592 | A * | 6/1964 | Miller | 439/314 |
| 5,422,487 | A * | 6/1995 | Sauska et al. | 250/436 |
| 5,521,805 | A * | 5/1996 | Lim | 362/221 |
| 6,666,701 | B1 * | 12/2003 | Burkhardt et al. | 439/314 |
| 6,860,628 | B2 * | 3/2005 | Robertson et al. | 362/555 |
| 6,884,103 | B1 * | 4/2005 | Kovacs | 439/336 |
| 2003/0021110 | A1 * | 1/2003 | Noh | 362/217 |
| 2008/0074027 | A1 * | 3/2008 | Kovacs | 313/318.02 |

* cited by examiner

*Primary Examiner*—Jong-Suk (James) Lee
*Assistant Examiner*—Julie A Shallenberger
(74) *Attorney, Agent, or Firm*—Rosenberg, Klein & Lee

(57) ABSTRACT

A male terminal cap and a female terminal cap are mounted on the two ends of a strip light shade to form an extensible strip light shade. Electrical contacts are formed in the terminal caps for electrical coupling when two light shades are connected through mechanical coupling of the terminal caps.

12 Claims, 9 Drawing Sheets

EXTENSIBLE LIGHT SHADE

RELATED APPLICATIONS

The present application is based on, and claims priority from, Taiwan Application Serial Number 096105867, filed Feb. 16, 2007, the disclosure of which is hereby incorporated by reference herein in its entirety.

TECHNICAL FIELD

This disclosure relates to an extensible light shade, and to an assembly wherein multiple light shades can be cascaded through mechanical coupling of the terminal caps to illuminate a wider range. Electricity is automatically coupled between the cascaded light shades while the light shades are cascaded in position.

BACKGROUND

FIG. 1 Prior Art

FIG. 1 shows prior U.S. Pat. No. 7,156,537 that was published on Jan. 2, 2007, and discloses a light shade for mounting on a wall or on a ceiling. A light shade 2 is used for housing a light tube (not shown) to form a light set. Two terminal caps 6 are each mounted on one of the two ends of the light shade 2. Terminal cap 6 has two mounting holes 9 for mounting the light shade 2 onto a wall or a ceiling. The terminal cap 6 has a curved flange 18 matching with the edge of the light shade 2 for framing the light shade 2. The backside 16 of the light shade 2 keeps open for housing a light tube mounted on a wall or ceiling.

The traditional terminal cap 6 is designed to be plain for decoration only and has no electrical component. More than one independent light sets are used for a place where wider illumination is needed. Independent electrical lines need to be laid for each one of the light sets.

SUMMARY OF THE INVENTION

A first aspect of this invention is to provide a light shade that is extensible to connect with an additional light shade through its structurally coupled terminal caps.

A second aspect of this invention is to provide a terminal cap having an electrical contact designed in for electrical coupling between cascaded light shades.

A third aspect of this invention is to provide an extensible light shade without using additional electrical wiring for each of the light set when multiple light sets are cascaded.

A fourth aspect of this invention is to provide a male terminal cap and a female terminal cap separately mountable on the two ends of a light shade, so that more light shades can be cascaded through connection of the terminal caps.

BRIEF DESCRIPTION OF THE DRAWING

FIG. 2C is a right view.

FIG. 2A is a left view.

DETAILED DESCRIPTION OF EMBODIMENTS

Figure 1:
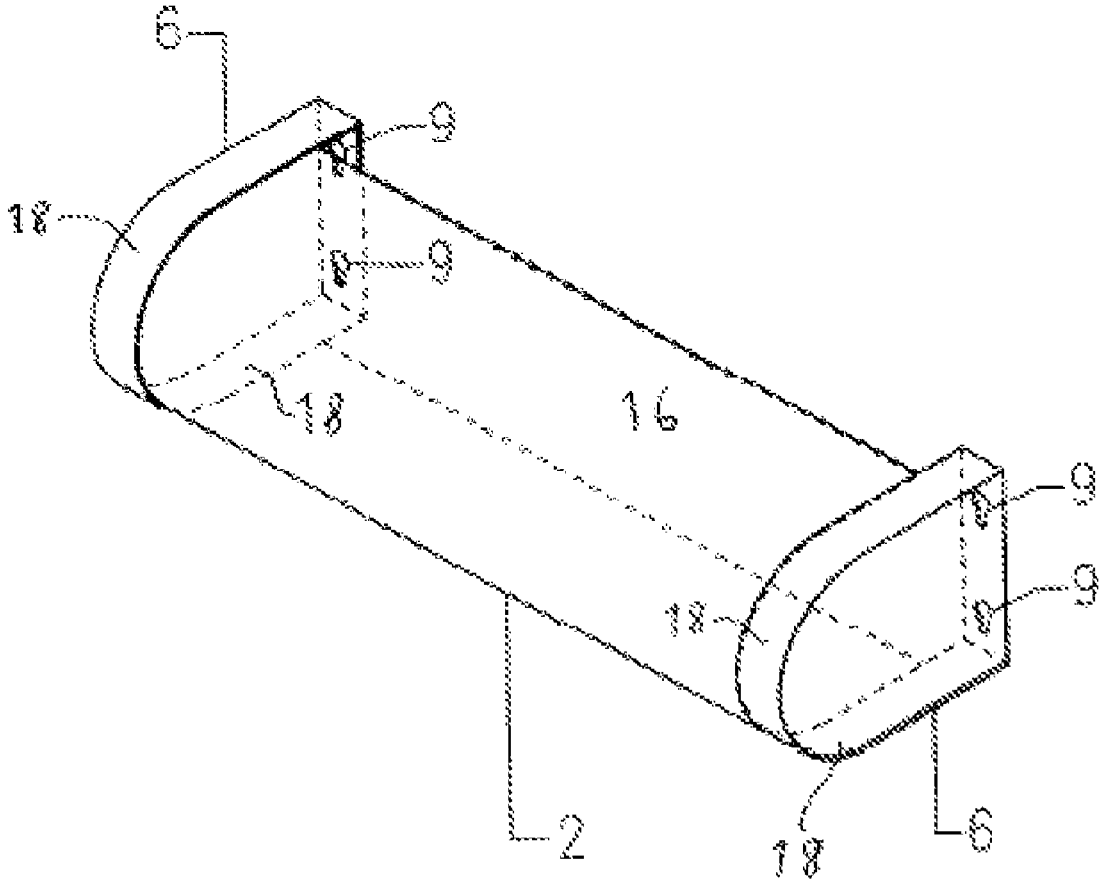
Fig. 1. Prior Art
FIG. 1 is a prior art light shade.
Figures 2A, 2B, 2C:
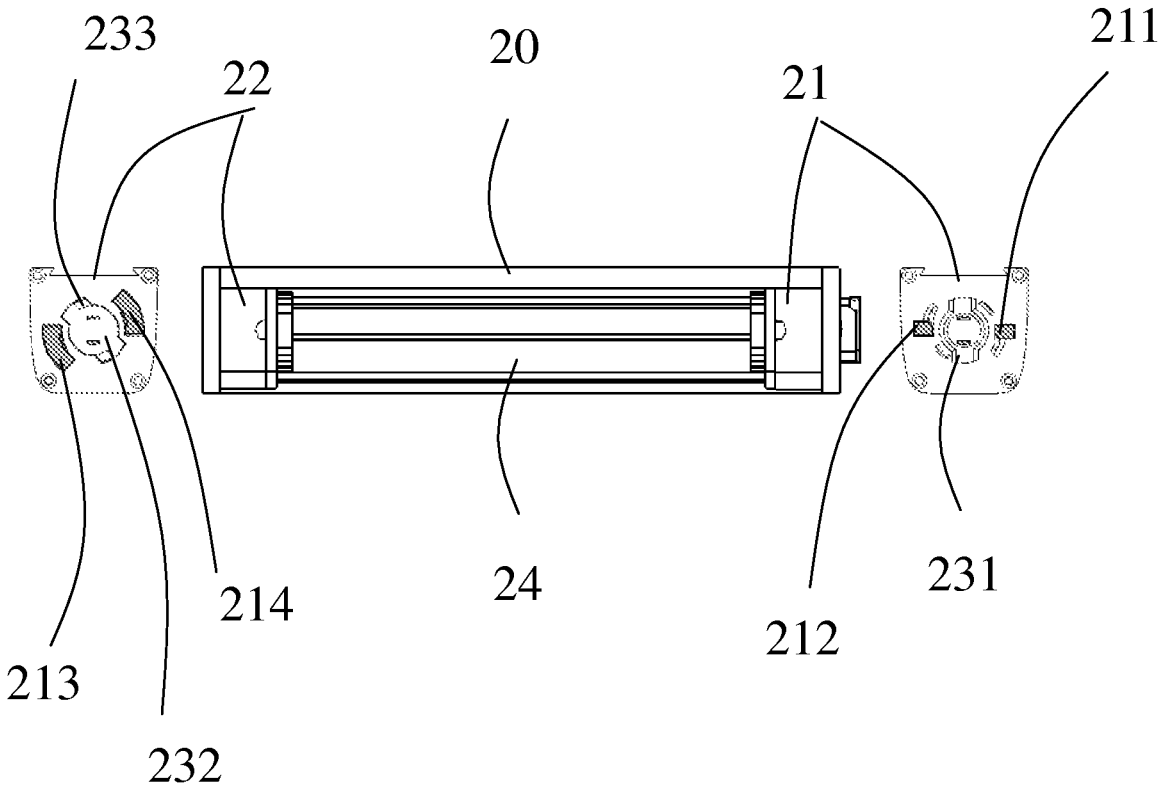
FIGS. 2C~2A show an embodiment of this invention.
FIG. 2B is a front view.

FIGS. 2C~2A show an embodiment of this invention.

FIG. 2C is a right view.

A male terminal cap 21 is mounted on the right side of the light shade 20, the male terminal cap 21 has a first metal contact 211, a second metal contact 212, and a male fastener 231.

FIG. 2B is a front view.

The light shade 20 has a right terminal cap 21 and a left terminal cap 22. A light tube 24 is mounted in the hollow space of the light shade 20.

FIG. 2A is a left view.

A female terminal cap 22 is mounted on the left side of the light shade 20, the female terminal cap 22 has a third metal contact 213, a fourth metal contact 214, and a female fastener 232. A guide plate 233 is made for guiding the inserted male fastener.

Figure 3:
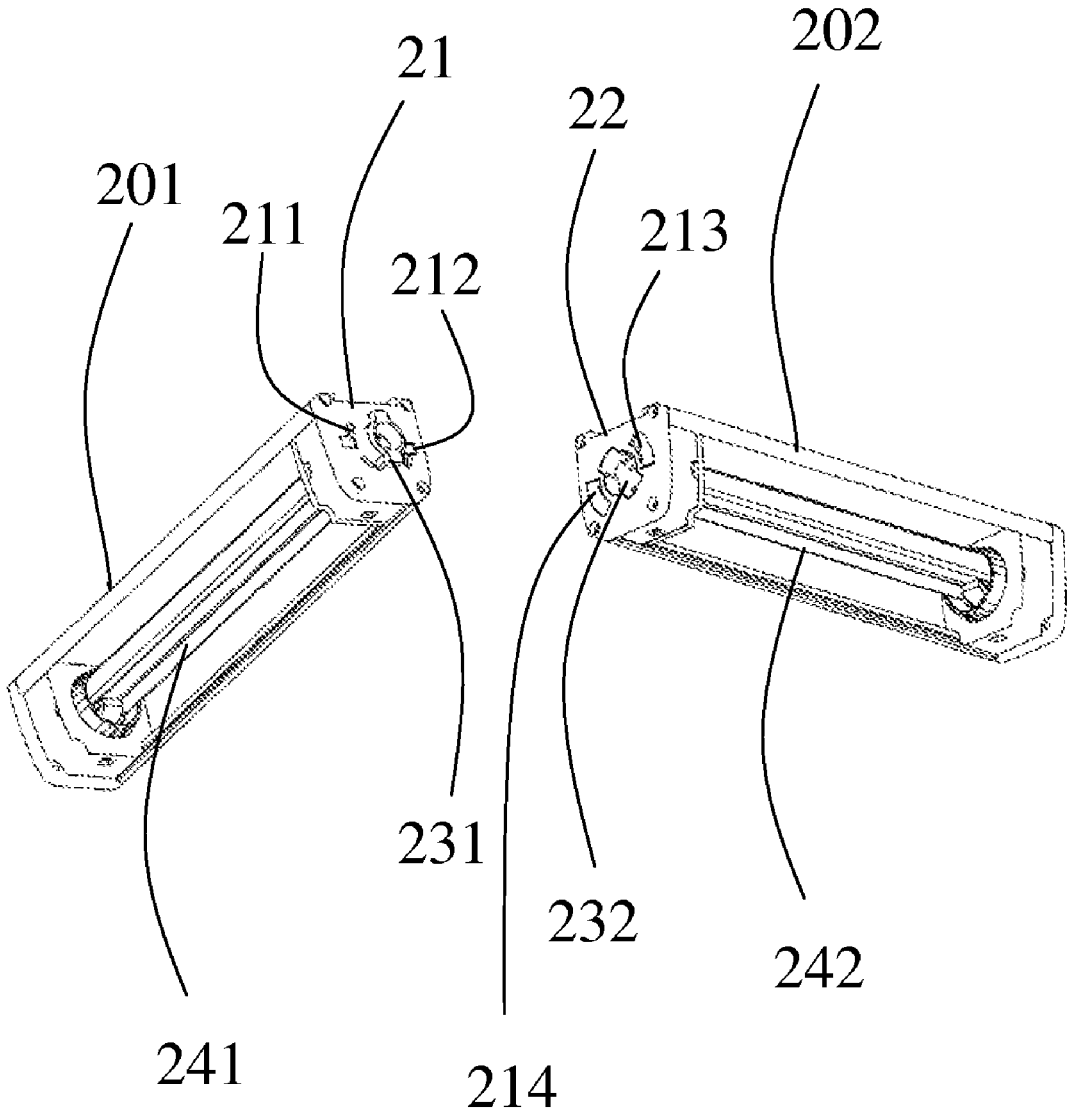
FIG. 3 is an elevation view of an embodiment of this invention.

FIG. 3 is an elevation view of the embodiment of FIGS. 2A-2C.

A first light shade 201 and a second light shade 202 are going to be cascaded. The light shade 201 has a light tube 241 housed inside, and the light shade 202 has a light tube 242 housed inside. The outline of the light tube 241 and 242 is similar to that of a conventional fluorescent light tube. Each end of the light tube 241 and 242 has two metal stems for electrical coupling to the metal contacts in the terminal caps.

Referring to FIG. 3, the light tube 242 has two metal stems (not shown) on its left side being electrically coupled to the two metal contacts 213 and 214 respectively of the left female terminal cap 22. Similarly, the light tube 241 has two metal stems (not shown) on its right side being electrically coupled to the two metal contacts 211 and 212 respectively of the right male terminal cap 21. The right male terminal cap 21 is going to couple with the left female terminal cap 22. The male fastener 231 of the terminal cap 21 is going to be inserted into the female fastener 232 of the terminal cap 22 for connecting the two light shades 201 and 202 and meanwhile comes into electrical contact with each other.

Figure 4:
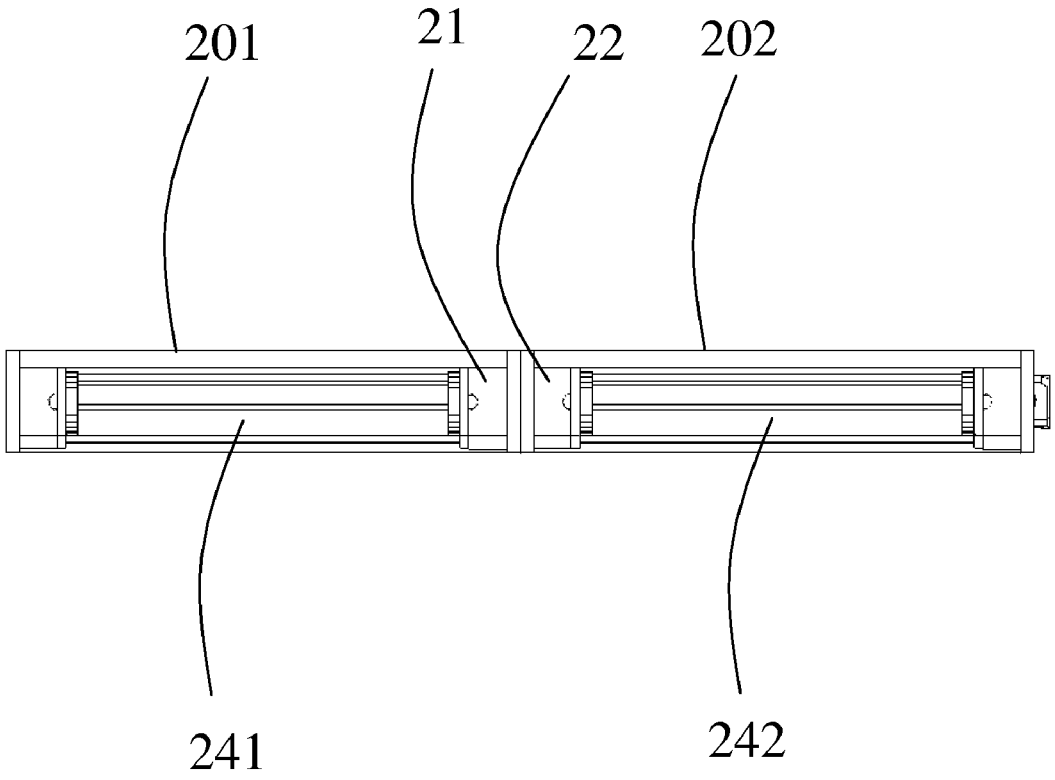
FIG. 4 is a front view of cascaded light sets with two light shades of embodiments of this invention.

FIG. 4 is a front view of a cascaded light set of two units 201, 202. The light shade 201 is cascaded with the light shade 202 through mechanical coupling of the male terminal cap 21 to the female terminal cap 22 by insertion and rotation. The two metal contacts in the male terminal cap 21 are electrically coupled to the two metal contacts in the female terminal cap 22.

Figure 5:
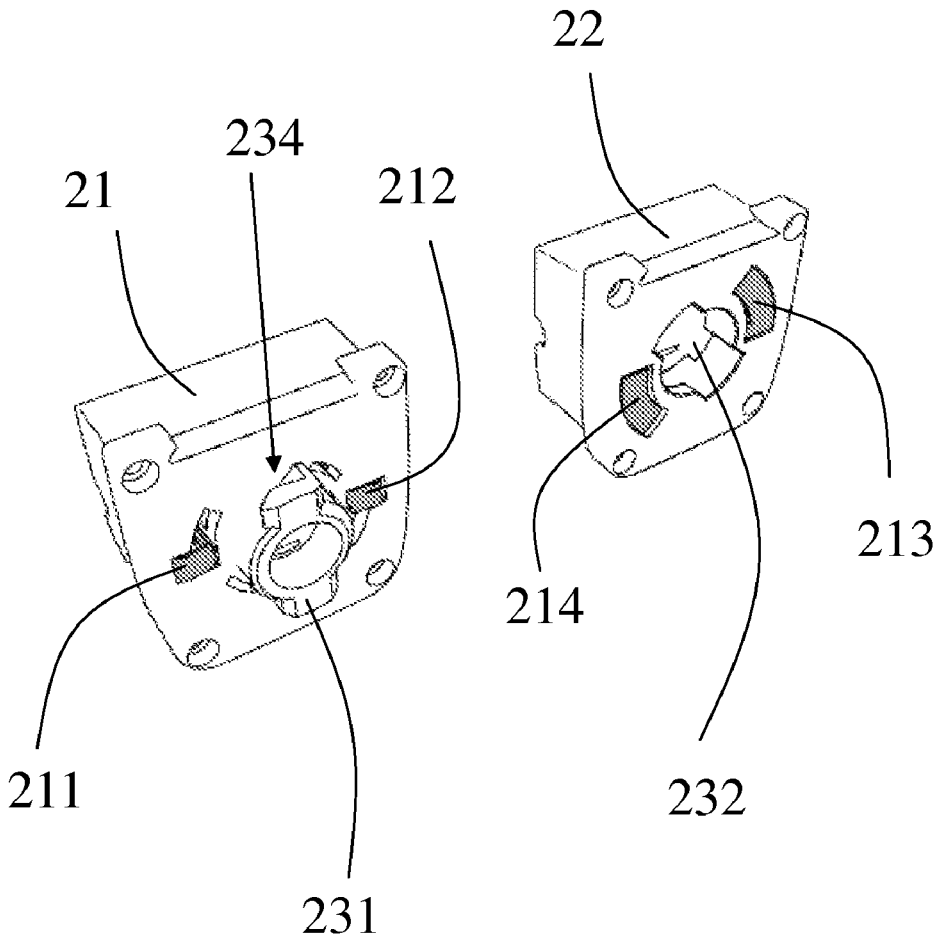
FIG. 5 is an elevation view of a male terminal cap and a female terminal cap of an embodiment of this invention.

FIG. 5 is an elevation view of a male terminal cap and a female terminal cap of an embodiment of this invention.

The male terminal cap 21 has a male fastener 231, a pair of L shaped flanges 231 mounted on the substrate of the terminal cap 21 to form a U shaped mouth 234 for example. The female terminal cap 22 has a female fastener 232, a hole and a flange, for example, for mechanical coupling to the male fastener 231. The male fastener 231 is then inserted into the female fastener 232 and rotated to be fixed in position. The flange of the female fastener is held in the mouth 234 for fixation of the cascaded light shades while the two light shades are cascaded in position as shown in FIG. 4.

The male terminal cap 21 has a first metal contact 211 and a second metal contact 212. The female terminal cap 22 has a third metal contact 213 and a fourth metal contact 214. The first metal contact 211 is electrically coupled to the third metal contact 213, and the second metal contact 212 is electrically coupled to the fourth metal contact 214 when the two light shades 201 and 202 are cascaded in position.

Figures 6A, 6B, 6C:
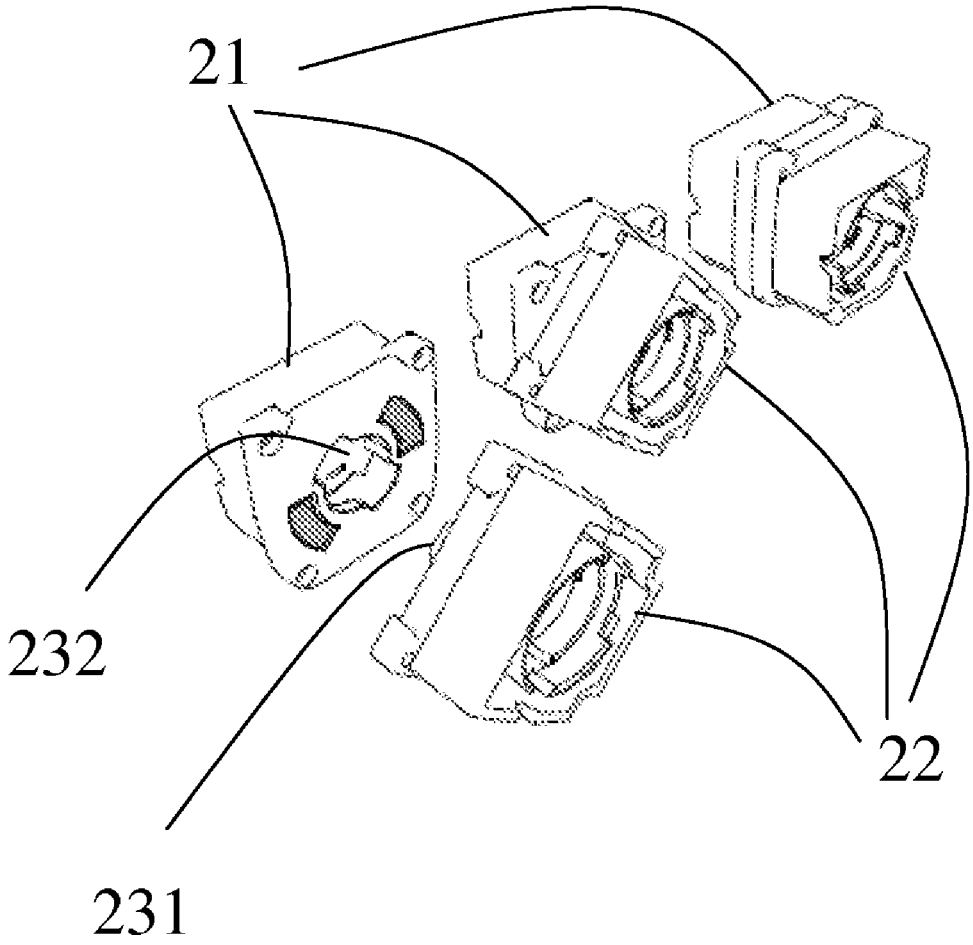
FIGS. 6A~6C show a process for coupling a male terminal cap to a female terminal cap.

FIGS. 6A~6C show a process for connecting a male terminal cap to a female terminal cap.

FIG. 6A is a view before connection; FIG. 6B is a view of insertion of the male terminal cap 21 into the female terminal cap 22; FIG. 6C is a view after insertion and rotation to fix the caps in position.

Figures 7A, 7B, 7C:
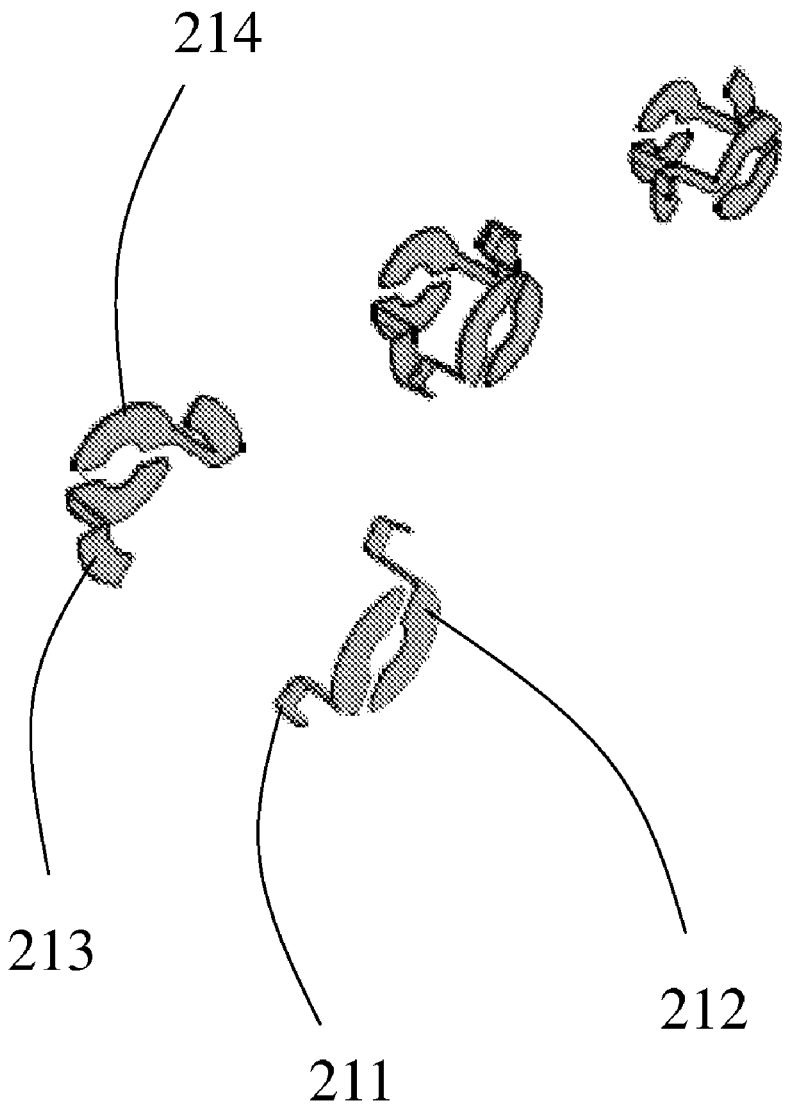
FIGS. 7A~7C show metal contacts in the two terminal caps.

FIGS. 7A~7C show the metal contacts in the two terminal caps.

FIGS. 7A~7C correspond to FIGS. 6A~6C, respectively. FIGS. 7A~7C show the action of the metal contacts in the terminal caps.

FIG. 7A shows the metal contacts before connection.

FIG. 7B shows the metal contacts touch each other when the male fastener is inserted into the female fastener.

FIG. 7C shows the metal contacts in position after the male fastener is fixed with the female fastener in position. The first metal contact 211 is electrically coupled to the third metal contact 213; and the second metal contact 212 is electrically coupled to the fourth metal contact 214 when the fastener pair is fixed in position.

Figure 8:
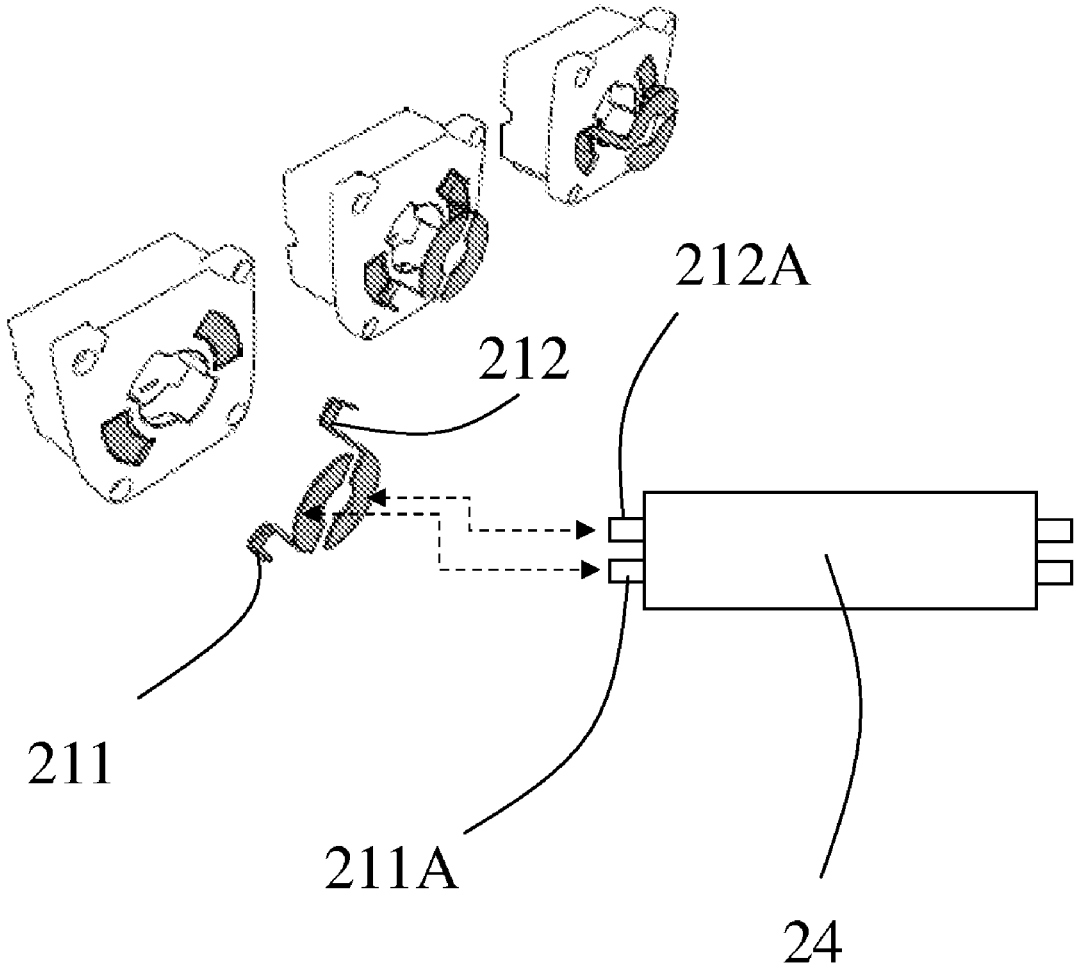
FIG. 8 shows two metal contacts in each of the terminal caps for a light tube having a pair of metal contacts in each of its two ends.

FIG. 8 shows two metal contacts in each of the terminal caps for a light tube having a pair of metal contacts in each of its two ends.

If the light tube 24 has two metal stems 211A and 212A in each of its two ends, the two metal stems 211A and 212A are electrically coupled to the two metal contacts 211 and 212 in the terminal cap. The other end of the light tube 24 also has two metal stems that are electrically coupled to the two metal contacts 213 and 214 in the terminal cap.

Figure 9:
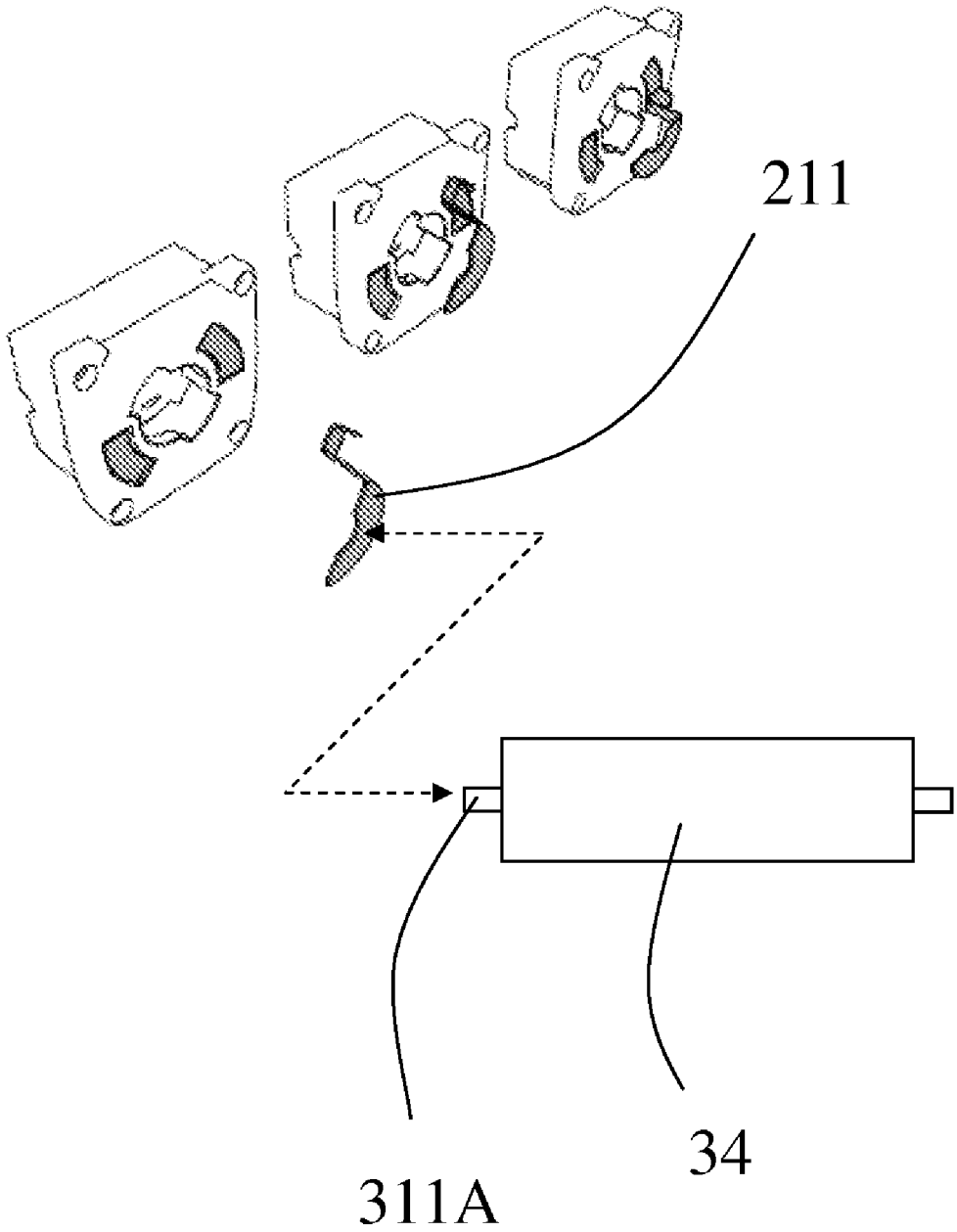
FIG. 9 shows a single metal contact in each of the terminal caps for a light tube having a single metal contact in each of its two ends.

FIG. 9 shows a single metal contact in each of the terminal caps for a light tube having a single metal contact in each of its two ends.

If the light tube 34 has a single metal stem 311A in each of its two ends, the single metal stem 211A is electrically coupled to the single metal contact 211 in the terminal cap. The other end of the light tube 24 also has a single metal stem that is electrically coupled to the other single metal contact in the terminal cap.

The fastener unit in embodiments of the invention is exemplified to be a pair of a mouth and a flange combined through insertion and rotation. However, different mechanisms can also be used, such as sliding and spring mechanisms for combination two articles. These different designs are within the scope of this invention.

The metal contacts in the terminal caps are exemplified to be separately arranged, they can also be integrated with the fastener elements to simplify the mechanism.

The light tubes can be fluorescent light tubes or include light emitting diodes.

While several embodiments have been described by way of example, it will be apparent to those skilled in the art that various modification may be made in the embodiments without departing from the spirit of the present invention. Such modifications are all within the scope of the present invention, as defined by the appended claims.

What is claimed is:

1. An extensible light shade, comprising:

a first light shade, having a first end and a second end;

a male terminal cap, mounted on said first end, and having a male fastener and a first metal contact located at a periphery of said male fastener, said first metal contact having a first planar contacting surface; and a female terminal cap, mounted on said second end, and having a female fastener and a second metal contact located at a periphery of said female fastener, said second metal contact having a second planar contacting surface;

whereby said male fastener of said first light shade is rotatably insertable into a female fastener of a second light shade at a predetermined angle for locking engagement therewith, said male fastener of said light shade thereby fastens with said female fastener of said second light shade, and a metal contact located at a periphery of said female fastener of said second light shade mechanically contacts and electrically connects with said first metal contact of said first light shade; a third metal contact, mounted in said male terminal cap, and wherein the first and third metal contacts surround the male fastener; and a fourth metal contact, mounted in said female terminal cap, and wherein the second and forth metal contacts surround said female fastener.

2. An extensible light shade assembly, comprising more than one extensible light shade as claimed in claim 1 cascaded onto each other.

3. An extensible light shade assembly, comprising more than one extensible light shade as claimed in claim 1 cascaded onto each other.

4. An extensible light shade as claimed in claim 1, further comprising:

a light tube, housed in said light shade.

5. An extensible light shade as claimed in claim 4, wherein said light tube is composed of at least one light emitting diode.

6. An extensible light shade as claimed in claim 4, wherein the light tube has a first end and a second end, the first end having at least one metal stem making direct electrical contact with the at least one first metal contact, the second end having at least one metal stem making direct electrical contact with the at least one second metal contact.

7. An extensible light shade, comprising:

a light shade, having a first end and a second end;

a male terminal cap, mounted on said first end, and having a male fastener and a first metal contact located at a peripheral of said male fastener, said first metal contact having a first planar contacting surface; and a female terminal cap, mounted on said second end, and having a female fastener and a second metal contact located at a peripheral of said female fastener, said second metal contact having a second planar contacting surface;

wherein said male fastener is structurally corresponding to said female fastener, and able to insert into and rotate against said female fastener at a predetermined angle for locking engagement with said female fastener, said first metal contact and said second metal contact are able to mechanically contact and electrically connect with each other, said first planar contacting surface and said second planar contacting surface are able to slidably contact each other when said male fastener rotates against said female fastener; a third metal contact, mounted in said male terminal cap, and wherein the first and third metal contacts surround the male fastener; and a forth metal contact, mounted in said female terminal cap, and wherein the second and forth metal contacts surround the female fastener.

8. An extensible light shade assembly, comprising more than one extensible light shade as claimed in claim 7 cascaded onto each other.

9. An extensible light shade assembly, comprising more than one extensible light shade as claimed in claim 7 cascaded onto each other.

10. An extensible light shade as claimed in claim 7, further comprising:

a light tube, housed in said light shade.

11. An extensible light shade as claimed in claim 10, wherein said light tube is composed of at least one light emitting diode.

12. An extensible light shade as claimed in claim 10, wherein the light tube has a first end and a second end, the first end having at least one metal stem making direct electrical contact with the at least one first metal contact, the second end having at least one metal stem making direct electrical contact with the at least one second metal contact.

* * * * *